US006912936B2

(12) United States Patent
Hume

(10) Patent No.: US 6,912,936 B2
(45) Date of Patent: Jul. 5, 2005

(54) HOLDING TOOL AND METHOD OF USE

(75) Inventor: Timothy P. Hume, Orange, CA (US)

(73) Assignee: Schley Products, Inc., Anaheim, CA (US)

( * ) Notice: Subject to any disclaimer, the term of this patent is extended or adjusted under 35 U.S.C. 154(b) by 0 days.

(21) Appl. No.: 10/327,377

(22) Filed: Dec. 20, 2002

(65) Prior Publication Data

US 2003/0121375 A1 Jul. 3, 2003

Related U.S. Application Data

(60) Provisional application No. 60/344,784, filed on Jan. 3, 2002.

(51) Int. Cl.[7] ..... B25B 9/00

(52) U.S. Cl. ..... 81/119; 81/176.1; 81/13

(58) Field of Search ..... 81/119, 176.1, 81/13, 176.15, 176.2, 487, 186, 55

(56) References Cited

U.S. PATENT DOCUMENTS 1,425,845 A * 8/1922 Foster ..... 81/176.15
1,528,892 A * 3/1925 Pigott et al. ..... 81/119
3,706,244 A * 12/1972 Wilmeth ..... 81/57.32
5,428,853 A * 7/1995 Menke et al. ..... 7/138
5,671,644 A * 9/1997 Anderson ..... 81/119
6,334,375 B1 * 1/2002 Belcher ..... 81/13
6,343,529 B1 * 2/2002 Pool ..... 81/13
6,427,558 B1 * 8/2002 DeLand ..... 81/13

* cited by examiner

*Primary Examiner*—Hadi Shakeri
(74) *Attorney, Agent, or Firm*—John J. Connors; Connors & Assoc. Inc.

(57) ABSTRACT

A holding tool is used to connect or disconnect a water pump pulley and a fan clutch. The water pump pulley is attached by a threaded shaft to a connector on the fan clutch, and the pulley has at least a pair of fasteners each with an exposed fastener head that extends from the pulley's surface which is next to the fan clutch. A head of the tool is inserted into a narrow space between the pulley's surface and the fan clutch. The tool head is narrow enough to fit into this space. This tool head includes a hook element at an end of a straight edge lever element. While grasping a fastener head of one fastener with the hook element and engaging a fastener head of another fastener with the straight edge lever element, a second tool is inserted into the narrow space to grasp the connector on the fan clutch. While both tools are engaged, one or both the tools are turned to disconnect or connect the threaded shaft of water pump pulley and the connector on a fan clutch.

1 Claim, 12 Drawing Sheets

HOLDING TOOL AND METHOD OF USE

RELATED PATENT APPLICATIONS & INCORPORATION BY REFERENCE

This application is a utility application based on U.S. provisional patent application Ser. No. 60/344,784 entitled "Universal Fan Clutch Pulley Holding Tool," filed Jan. 3, 2002. This related application is incorporated herein by reference and made a part of this application. If any conflict arises between the disclosure of the invention in this utility application and that in the related provisional application, the disclosure in this utility application shall govern. Moreover, Applicant incorporates herein by reference any and all U.S. patents, U.S. patent applications, and other documents cited or referred to in this application or cited or referred to in the U.S. patents and U.S. patent applications incorporated herein by reference.

DEFINITIONS

The words "comprising," "having," and "including," and other forms thereof, are intended to be equivalent in meaning and be open ended in that an item or items following any one of these words is not meant to be an exhaustive listing of such item or items, or meant to be limited to only the listed item or items.

BACKGROUND OF INVENTION

Automotive vehicles, especially sport utility vehicles, pickup trucks and vans, require periodic service of the viscous fan clutch assembly or water pump. The viscous fan clutch is coupled to the water pump shaft with a threaded coupling. This shaft is free wheeling, and must be held to prevent its rotation when connecting or disconnecting the shaft to the viscous fan clutch. The common method of removing the viscous fan clutch is to hold the water pump pulley stationary with a crowfoot style wrench. Then, using an open-ended wrench holding the threaded coupling the viscous fan clutch, with an opposite turning motion, unthread the viscous fan clutch from the water pump threaded shaft. Typically, this open-ended wrench has a size of, for example, 32 millimeter (mm), 36 mm, 40 mm, and 48 mm. The water pump shaft may be right or left hand threaded. Thus viscous fan clutch may be removed and replaced. The water pump pulleys are held to the water pump by a number of bolts. These bolts are usually in a group of four, five or even more, and their heads extend from the surface of the water pump pulley. The heads of these bolts are accessed and held by a specially designed wrench such as a crowfoot style wrench. This enables the open-ended wrench to remove or replace the viscous fan clutch. The water pump pulley crowfoot style wrench commonly used are designed specifically to a particular bolt head pattern and size found on the water pump pulleys. There consequently can be up to eight or more different designs of these water pump holding crowfoot style wrenches as numerous manufacturers use their own designs of water pumps, bolt patterns, and viscous fan clutch assemblies.

SUMMARY OF INVENTION

This invention, with its several desirable features, is summarized in the CLAIMS that follow. After reading the following section entitled "DETAILED DESCRIPTION OF SOME EMBODIMENTS OF THIS INVENTION," one will understand how the features of this invention provide its benefits. These benefits include, but are not limited to:

providing a single tool that may be used with a wide variety bolt head patterns and bolt head sizes found on conventional water pump pulleys, ease of use and manufacture, self-alignment on bolt heads, avoidance of damage to the water pump pulley and viscous fan clutch, and ability to access hard to reach locations.

Without limiting the scope of this invention as expressed by the claims that follow, some, but not all, of its features are: One, the tool of this invention has a tool head sized to fit into a narrow space between a surface of a water pump pulley and a fan clutch, and is used to grasp at least a pair exposed fastener heads extending from the pulley's surface, which is next to the fan clutch. The tool head, for example, has a thickness from 1/16 to 3/4 inch and a width from 2 to 10 inches.

Two, the tool head includes a hook arm and a lever arm joined together to provide a common edge. The common edge may have a terminal end including the hook arm. Typically, the tool head is substantially flat, having a thickness no greater than about 3/4 inch.

Three, the hook arm may include an outwardly projecting tip from which an arcuate edge portion curves inward. This arcuate edge portion is sized to enable it to grasp a head of one fastener with the arcuate edge portion bearing against this fastener head. The arcuate edge portion may be at a terminal end of the common edge.

Four, the lever arm has a straight edge portion that bears against the head of a fastener when the hook arm is grasping the head of another fastener. The straight edge portion may have an inner end merging with an inner end of the arcuate edge portion. The outer terminal end of the straight edge portion is free of any obstruction that would interfere with the lever arm and the straight edge portion bearing against a fastener head. Typically, the straight edge portion has a length of at least about 1 inch, and its length may range from about 1 to about 10 inches. The straight edge portion may include a plurality of edge segments that merge to form at least one angle. Typically, this angle may range from about 60 to about 180 degrees.

Five, the arcuate edge portion and the straight edge portion form, at least in part, the common edge.

Six, the tool head may be connected to a handle where the tool head and handle are integral or the tool head may include a connector component adapted to attach and detach the tool head to a handle.

These features are not listed in any rank order nor is this list intended to be exhaustive.

This invention also includes a method of connecting or disconnecting a water pump pulley and a fan clutch using a tool such as discussed above. The water pump pulley is attached by a threaded shaft to a connector on the fan clutch, and the pulley has at least a pair of fasteners, each with an exposed fastener head that extends from the pulley's surface which is next to the fan clutch. The tool head is inserted into the narrow space between the pulley's surface and the fan clutch. While grasping a fastener head of one fastener with the hook element and engaging a fastener head of another fastener with the straight edge lever element, a second tool is inserted into the narrow space to grasp the connector on the fan clutch. While both tools are engaged, one or both the tools are turned to disconnect or connect the threaded shaft of water pump pulley and the connector on the fan clutch.

DESCRIPTION OF DRAWINGS

Some embodiments of this invention, illustrating all its features, will now be discussed in detail. These embodiments depict the novel and non-obvious tool and method of this invention as shown in the accompanying drawings, which are for illustrative purposes only. These drawings includes the following figures (FIGS.), with like numerals indicating like parts.

DETAILED DESCRIPTION OF SOME EMBODIMENTS OF THIS INVENTION

Figure 1:
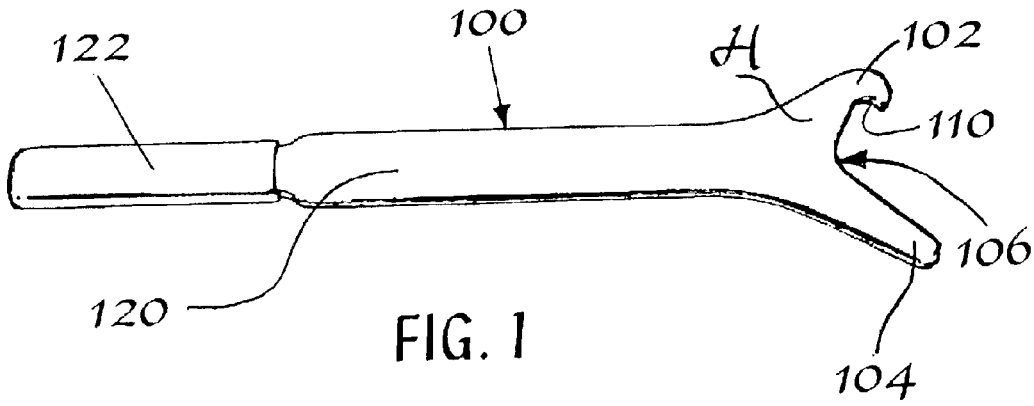
FIG. 1 is a perspective view of one embodiment of the tool of this invention.
Figure 2:
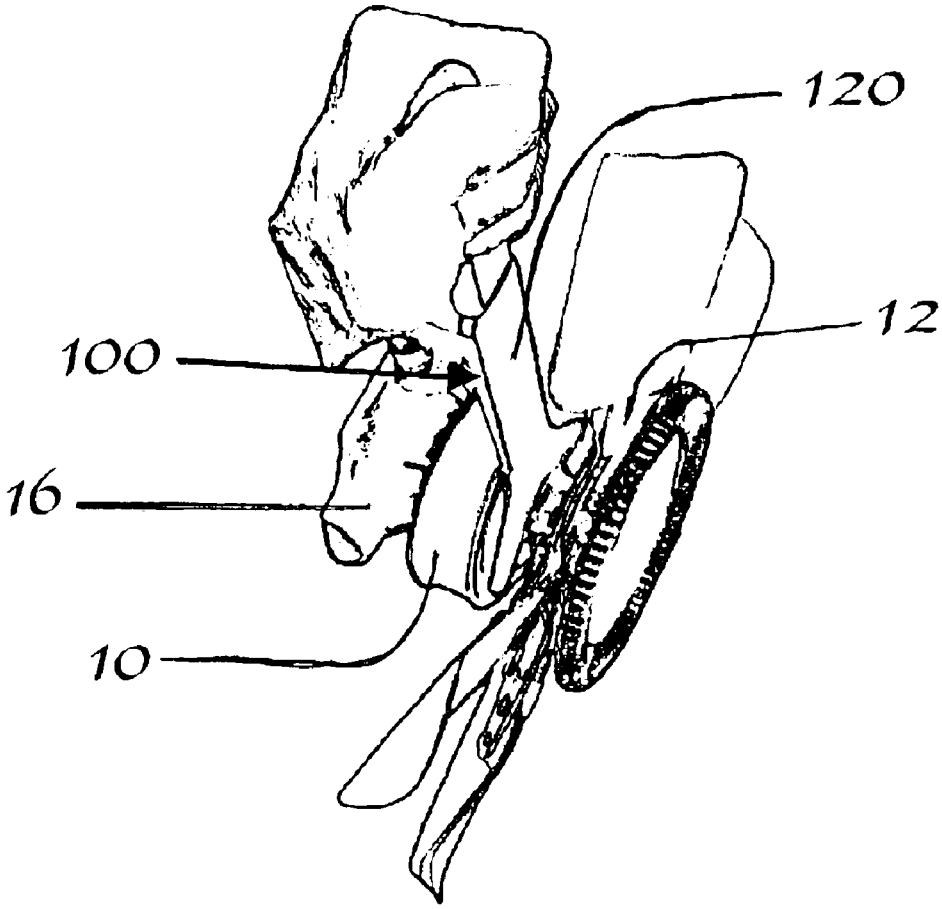
FIG. 2 is a perspective view of the tool shown in FIG. 1 being used to engage bolt heads projecting outward from a water pump pulley.
Figure 5:
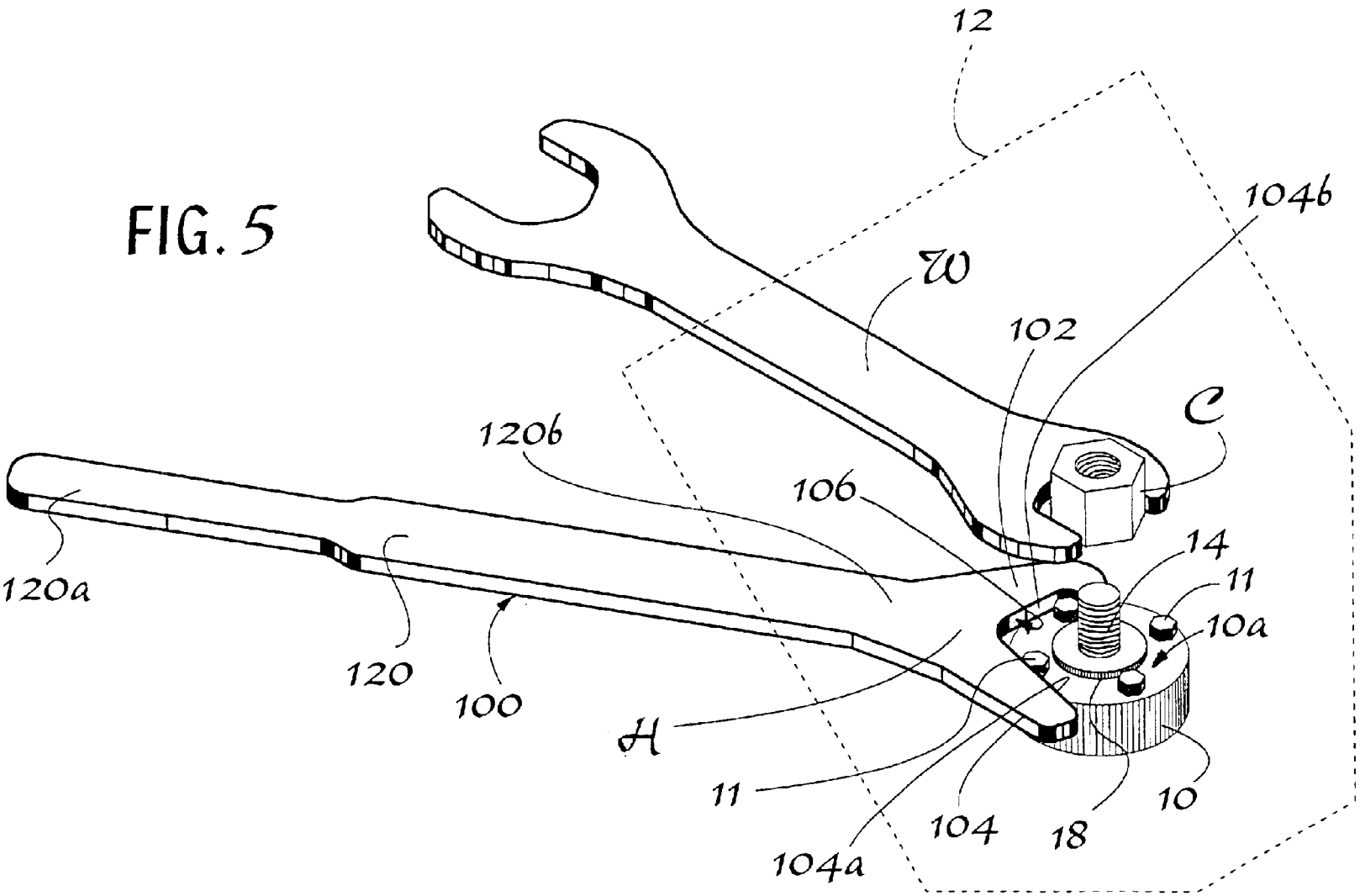
FIG. 5 is a perspective view of the tool shown in FIG. 1 being used with a wrench to rotate a nut holding a water pump shaft.

One embodiment of the tool of this invention, namely the holding tool 100, is shown in FIG. 1. As depicted in FIG. 2, the tool of this invention is primarily used with a fan clutch pulley 10 mounted on a water pump 16 and connected to a viscous fan clutch assembly 12. Using the tool 100 and a second tool such as a conventional open-ended wrench W (FIG. 5), the water pump 16 and viscous fan clutch assembly 12 may be connected and disconnected. As shown in FIG. 5, a threaded shaft 14 of the water pump 16 extends through a circular opening 18 centrally located in a top surface 10*a* of the pulley 10. Projecting outward from the surface 10*a* facing the viscous fan clutch assembly 12 are four spaced apart hexagonal fastener heads 11 (FIGS. 5 and 6) of fasteners, for example bolts. The tool 100, which has a head H, grasps at least two fastener heads 11 of the fasteners, while the wrench W grasps a hexagonal nut connector C of the viscous fan clutch assembly 12. This hexagonal nut connector C is coupled to the viscous fan clutch assembly 12 (shown in dotted lines in FIG. 5). The threaded shaft 14 of the water pump 16 is screwed and unscrewed into the hexagonal nut connector C, with the internal threads of hexagonal nut connector C engaging and disengaging the threads of the shaft. Upon connecting the shaft 14 to the hexagonal nut connector C, the surface 10*a* is next to the fan clutch to provide a narrow space between this surface 10*a* and the viscous fan clutch assembly 12. Typically, the distance between the surface 10*a* and the fan clutch assembly 12, i.e. the width of the space, is from about 1/16 to about 2 inches.

Figure 6:
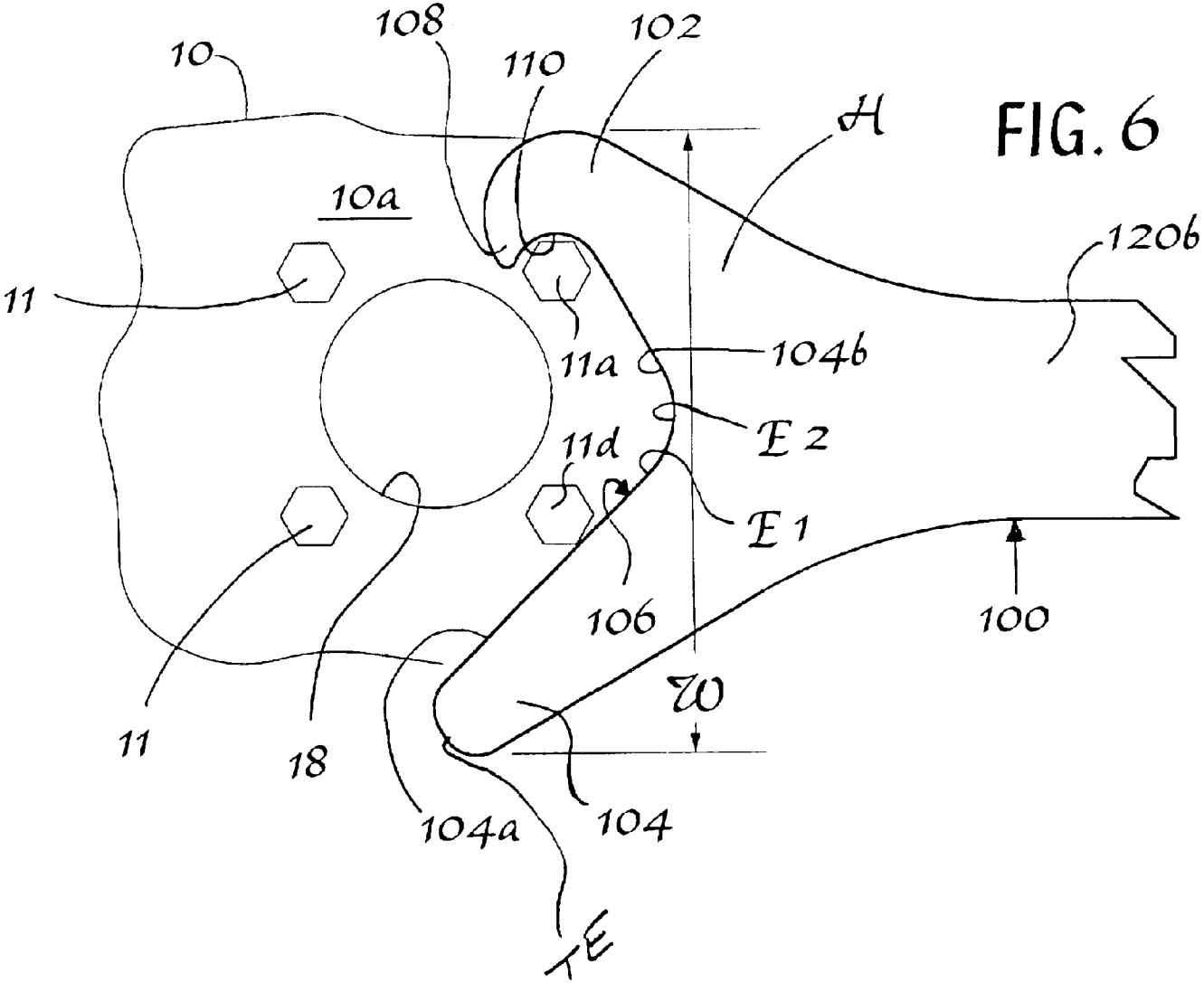
FIG. 6 is a plan view of the tool shown in FIG. 1 engaging two of four bolt heads on a water pump pulley positioned around the bore hole into which a water pump shaft is screwed.
Figure 7:
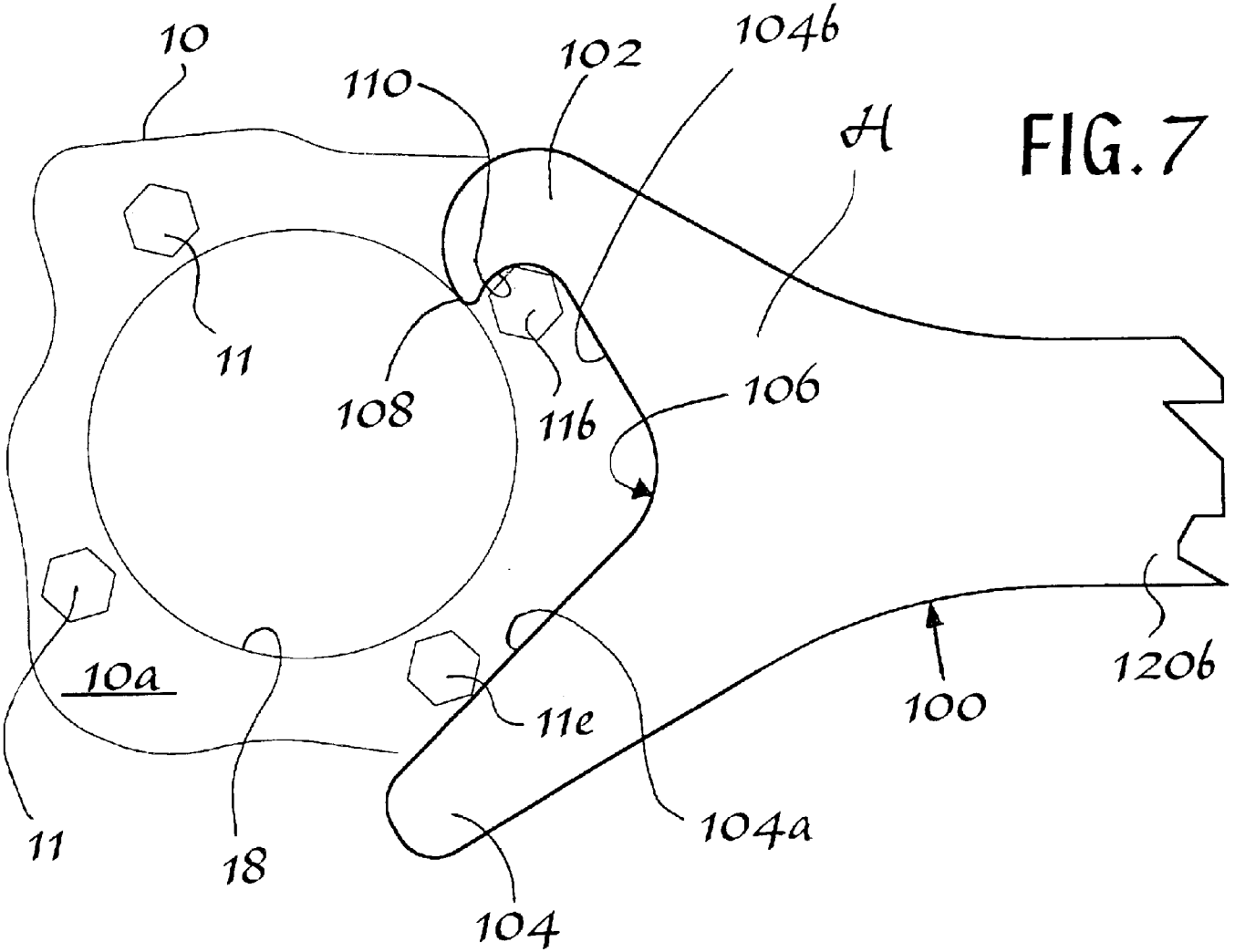
FIG. 7 is a plan view of the tool shown in FIG. 1 engaging two of four, widely spaced bolt heads on a water pump pulley positioned around an enlarged bore hole into which a water pump shaft extends.
Figure 8:
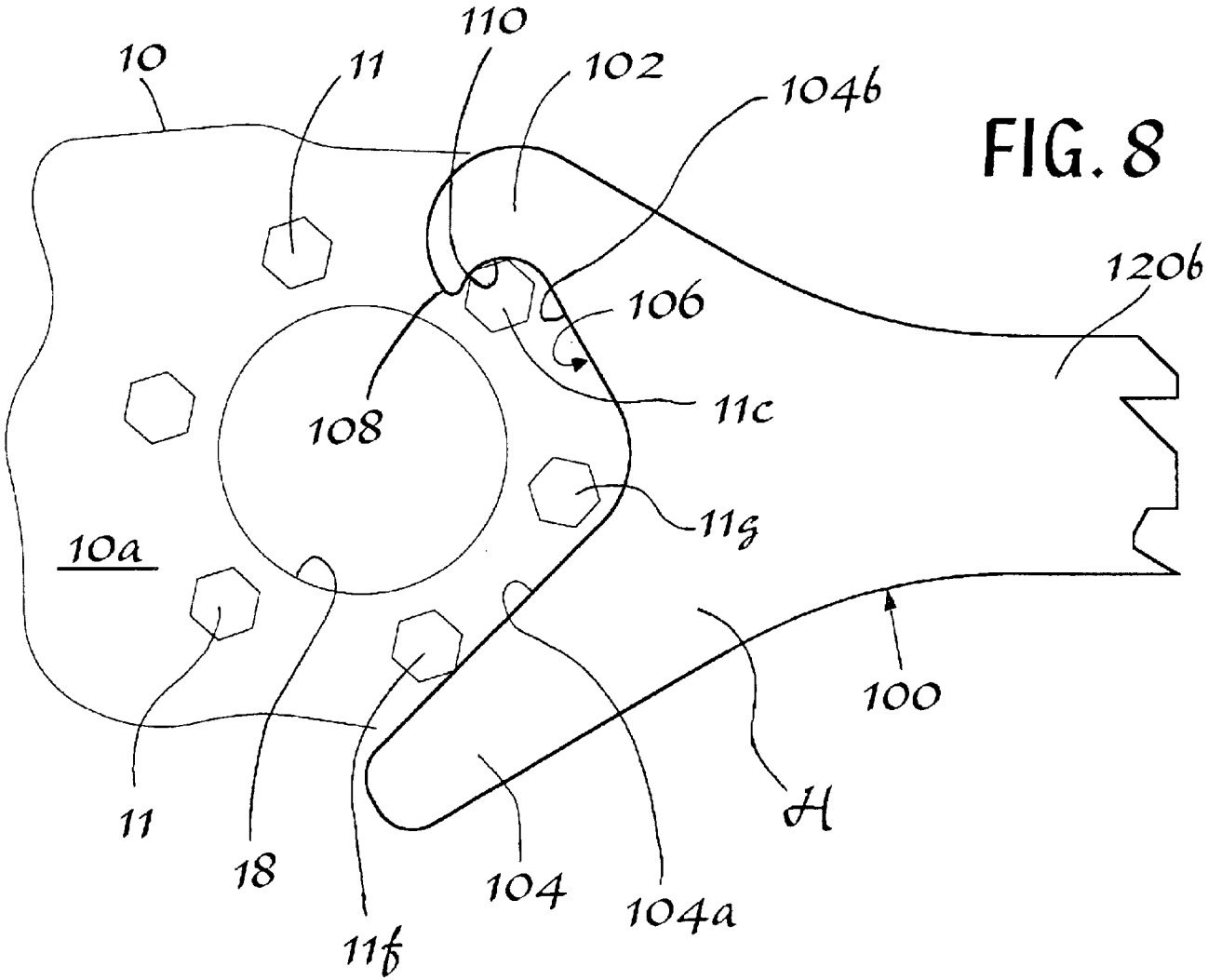
FIG. 8 is a plan view of the tool shown in FIG. 1 engaging three of six bolt heads on a water pump pulley positioned around a bore hole into which a water pump shaft extends.

As illustrated in FIG. 1, the tool head H is substantially flat having a thickness no greater than about ¾ inch. Typically, its width w (FIG. 6) is from about 4–5 inches. The tool head H includes a hook arm 102 and a lever arm 104 joined together to provide a common edge 106. The common edge 106 has a terminal end at which the hook arm 102 is located. As best depicted in FIGS. 6 through 8, the hook arm 102 includes an outwardly projecting pointed tip 108 from which an arcuate edge portion 110 curves inward to enable the hook arm to grasp one fastener head 11 of one fastener. Even though the number and spacing of the fastener heads 11 may be different, the arcuate edge portion 110 bears against the selected one of the fastener heads 11. In FIG. 6, the selected fastener head is identified by the numeral 11*a*. In FIG. 7, the selected fastener head is identified by the numeral 1*b*. In FIG. 8, the selected fastener head is identified by the numeral 11*c*.

The lever arm 104 has a straight edge portion 104*a* that bears against a second selected fastener head of another fastener when the arcuate edge portion 110 of the hook arm 102 is grasping the one fastener head of the first selected fastener. In FIG. 6, the second selected fastener head is identified by the numeral 11*d*. In FIG. 7, the second selected fastener head is identified by the numeral 11*e*. In FIG. 8, the second selected fastener head is identified by the numeral 11*f*. These second selected fastener heads may be adjacent as illustrated in FIGS. 6 and 7, or they may be separated by an another fastener head such the fastener head identified by the numeral 11*g* in FIG. 8.

Figure 9:
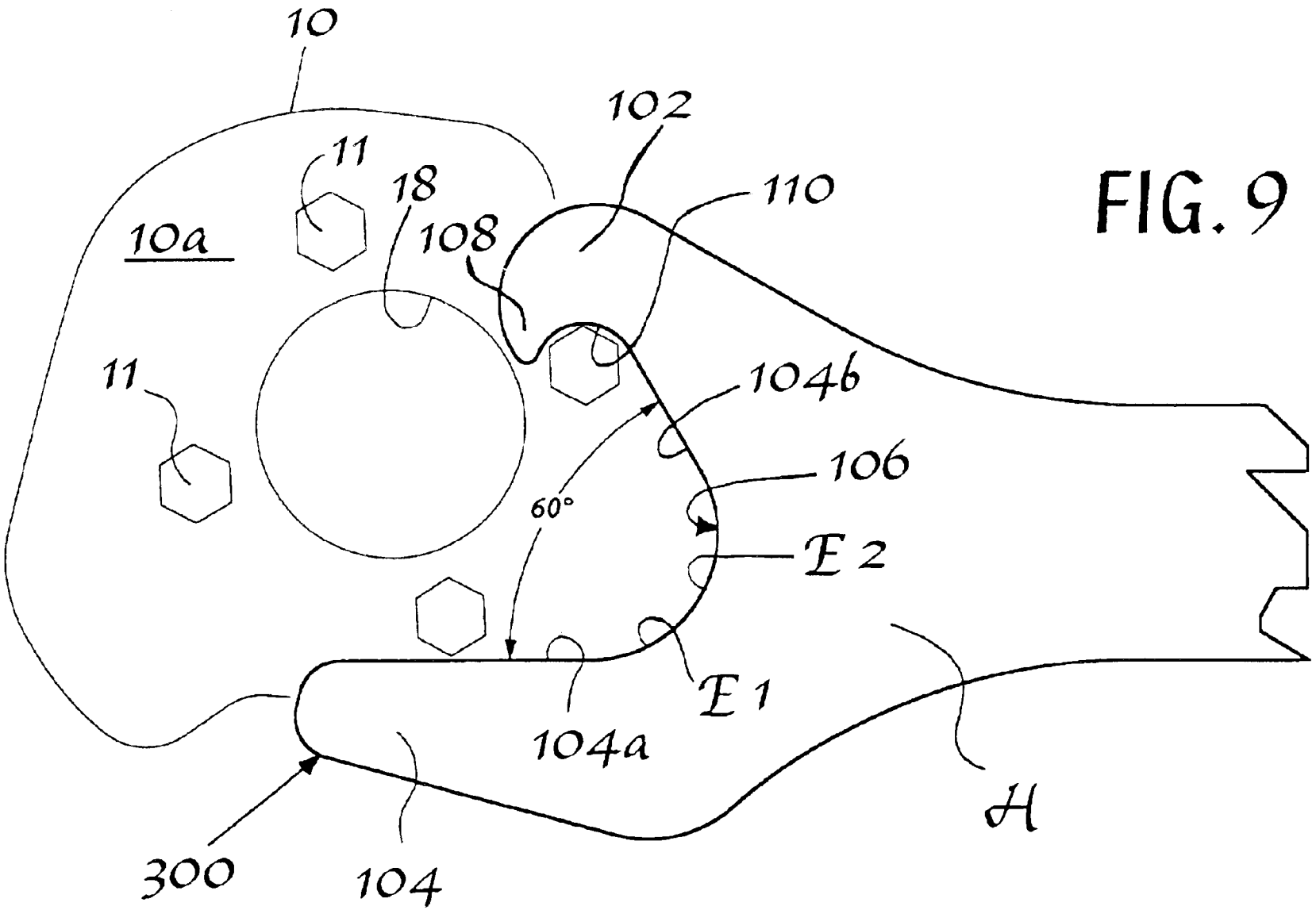
FIG. 9 is a plan view of a second embodiment of the tool of this invention engaging two of four bolt heads on a water pump pulley positioned around the bore hole into which a water pump shaft extends.
Figure 10:
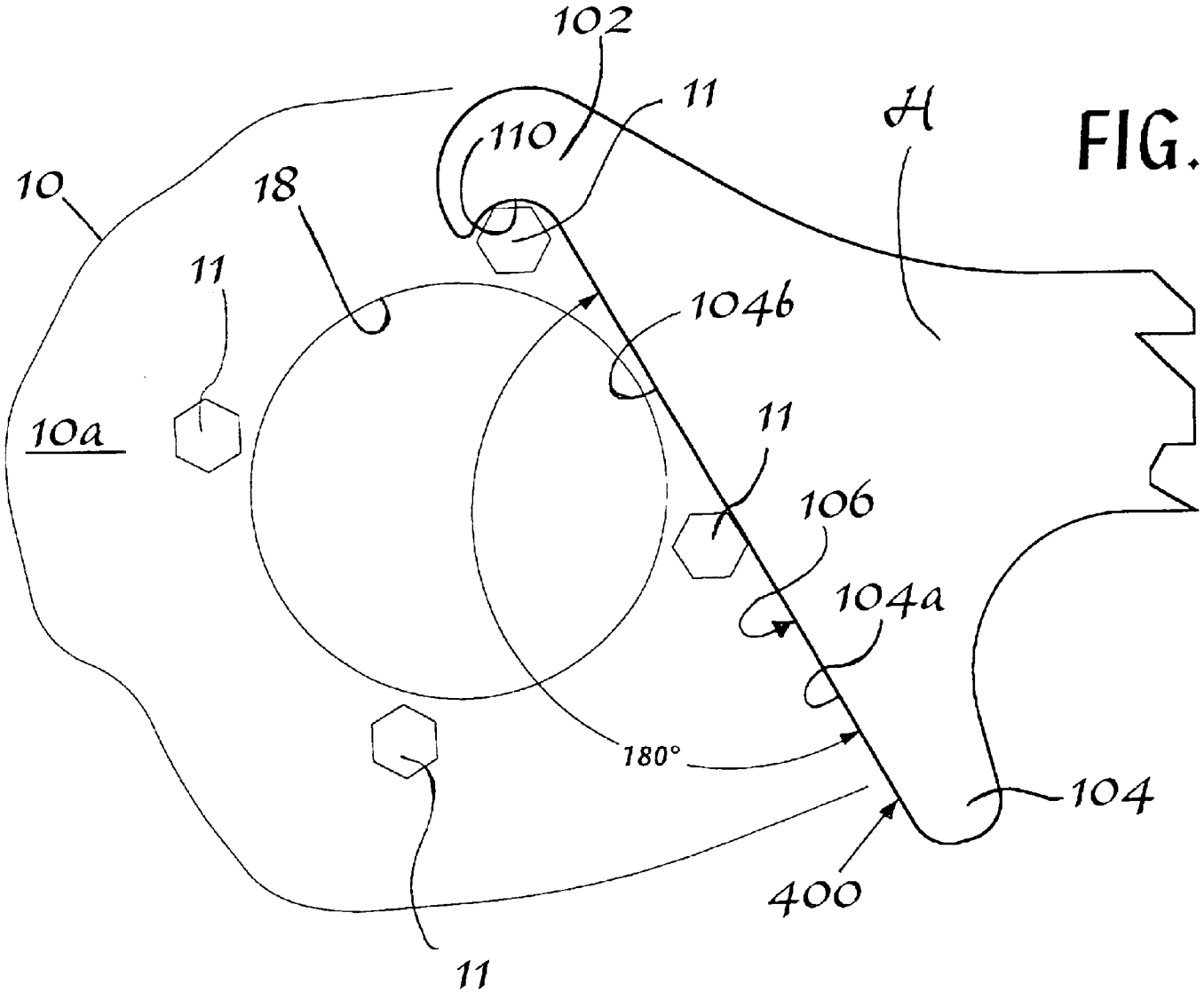
FIG. 10 is a plan view of a third embodiment of the tool of this invention engaging two of four bolt heads on a water pump pulley positioned around an enlarged bore hole into which a water pump shaft extends.
Figure 11:
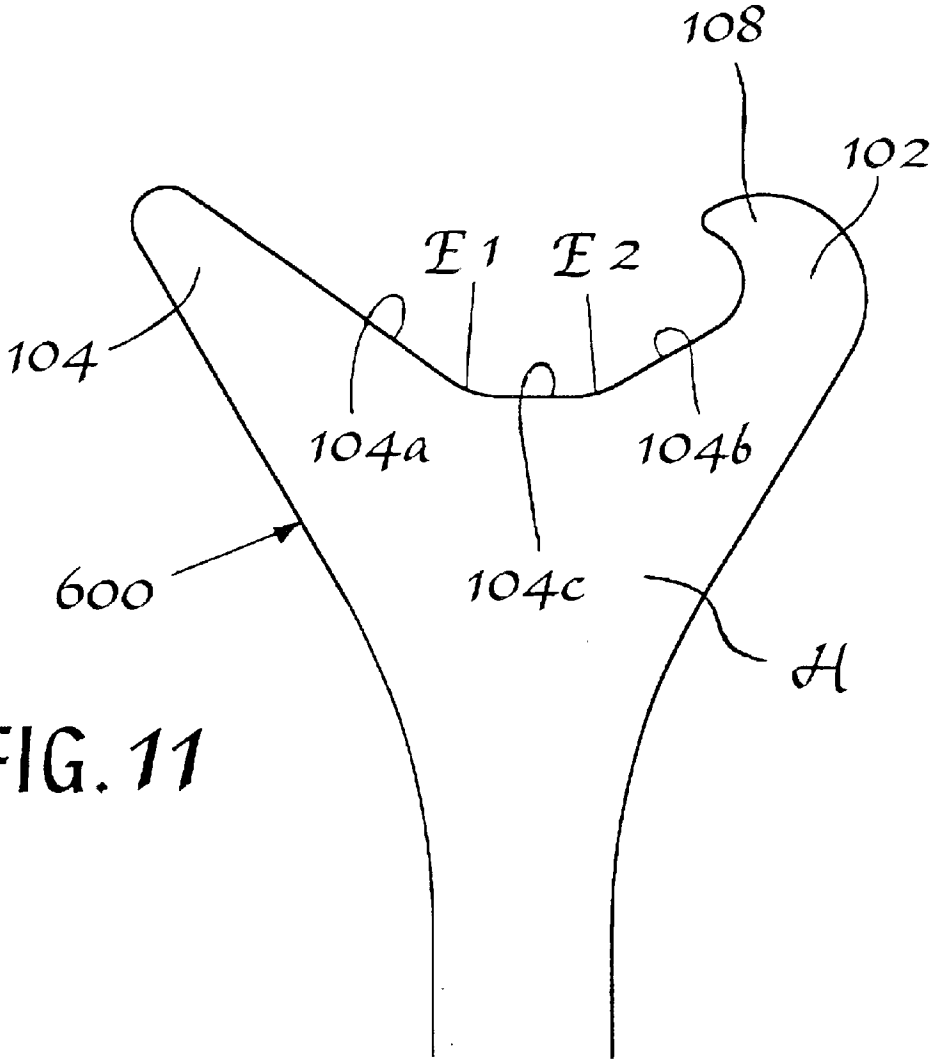
FIG. 11 is a plan view of a fourth embodiment of the tool of this invention.

The arcuate edge portion 110 and straight edge portion 104*a* form, at least in part, the common edge 106. The straight edge portion 104*a* may include a plurality of edge segments as best shown in FIGS. 6, 9, and 11, or a single edge segment as shown in FIGS. 10. The tool 100 includes a pair of edge segments, the straight edge portion 104*a* and another straight edge portion 104*b*. These segments 104*a* and 104*b* merge at inner ends E1 and E2, respectively, forming an obtuse angle of about 105 degrees. The straight edge portion 104*a* has outer terminal end TE that is free of any obstruction that would interfere with the lever arm 104 and the straight edge portion 104*a* bearing against a fastener head. The straight edge portion 104*a* has a length of about 2.5 inch, and straight edge portion 104*b* has a length of about 1.5 inch. In one embodiment, the tool 300 shown in FIG. 9, the segments 104*a* and 104*b* merge at the inner ends E1 and E2, respectively, to form an acute angle of about 60 degrees. In one embodiment, the tool 400 shown in FIG. 10, the segments 104*a* and 104*b* lie in a straight line forming an angle of 180 degrees.

Figure 12:
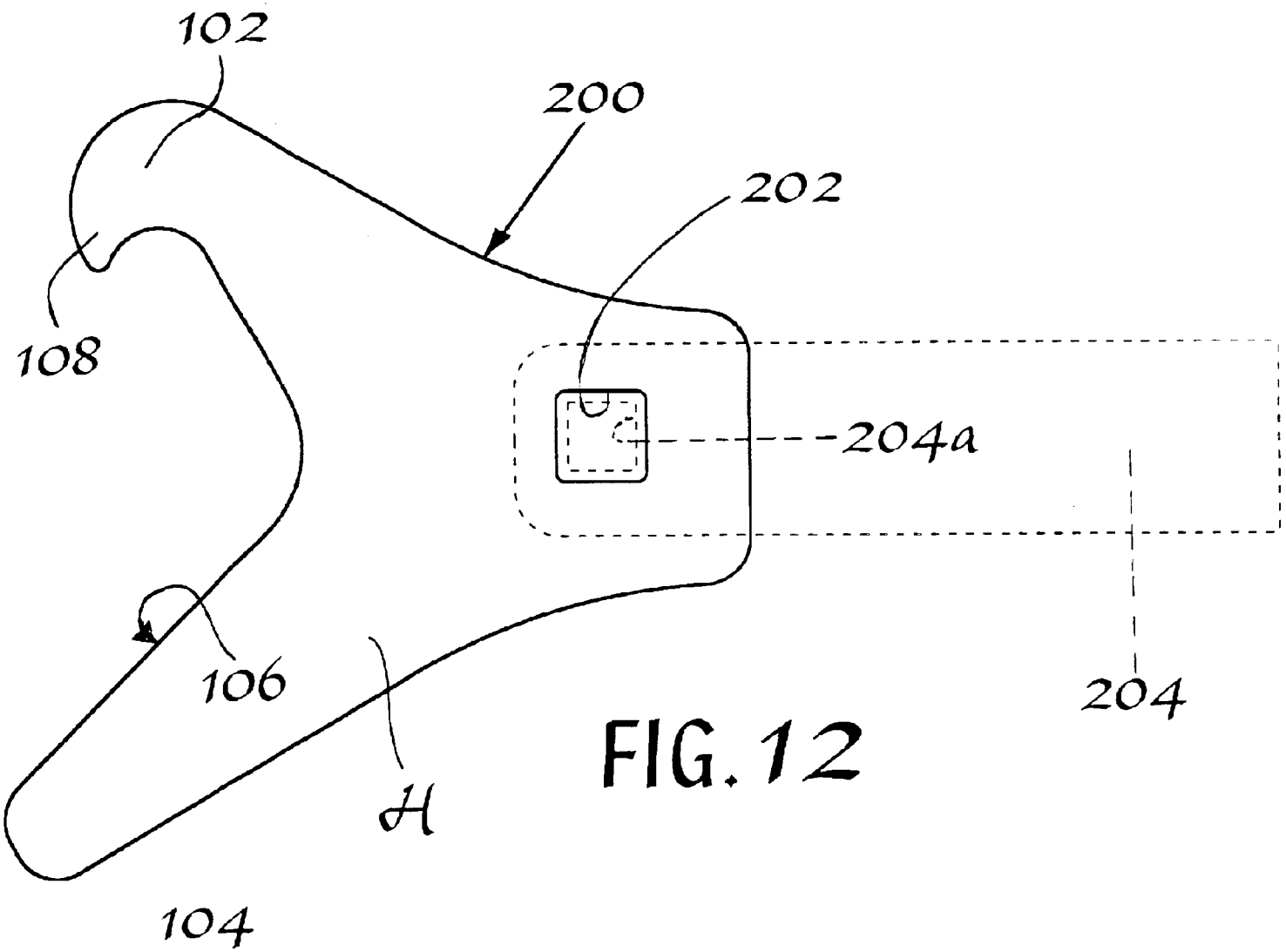
FIG. 12 is a plan view of a fifth embodiment of the tool of this invention.

As illustrated in FIG. 2, the tool head H is attached to a handle 120. In the tool 100, the tool head H and handle 120 are integral, being formed from a sheet of steel by a conventional metal stamping or cutting technique. The proximal end 120*a* of the handle 120 is slightly narrower than the distal end 120*b* connected to the tool head H. A grip 122, typically made of plastic, may be used. It slips over the proximal end 120*a* of the handle 120, and may be conveniently replaced when needed. In an alternate embodiment depicted in FIG. 12, the tool 200, the tool head H is a separate unit that includes a connector component in the form of a square opening 202 adapted to attach and detach the tool head to a handle 204 shown in dotted lines. The handle 204 includes a rigid square shaped finger 204*a* (shown in dotted lines) that fits into the square opening 202 to connect the handle to the tool head H and allows for quick disconnection by simply pulling the finger from the opening.

Figure 3:
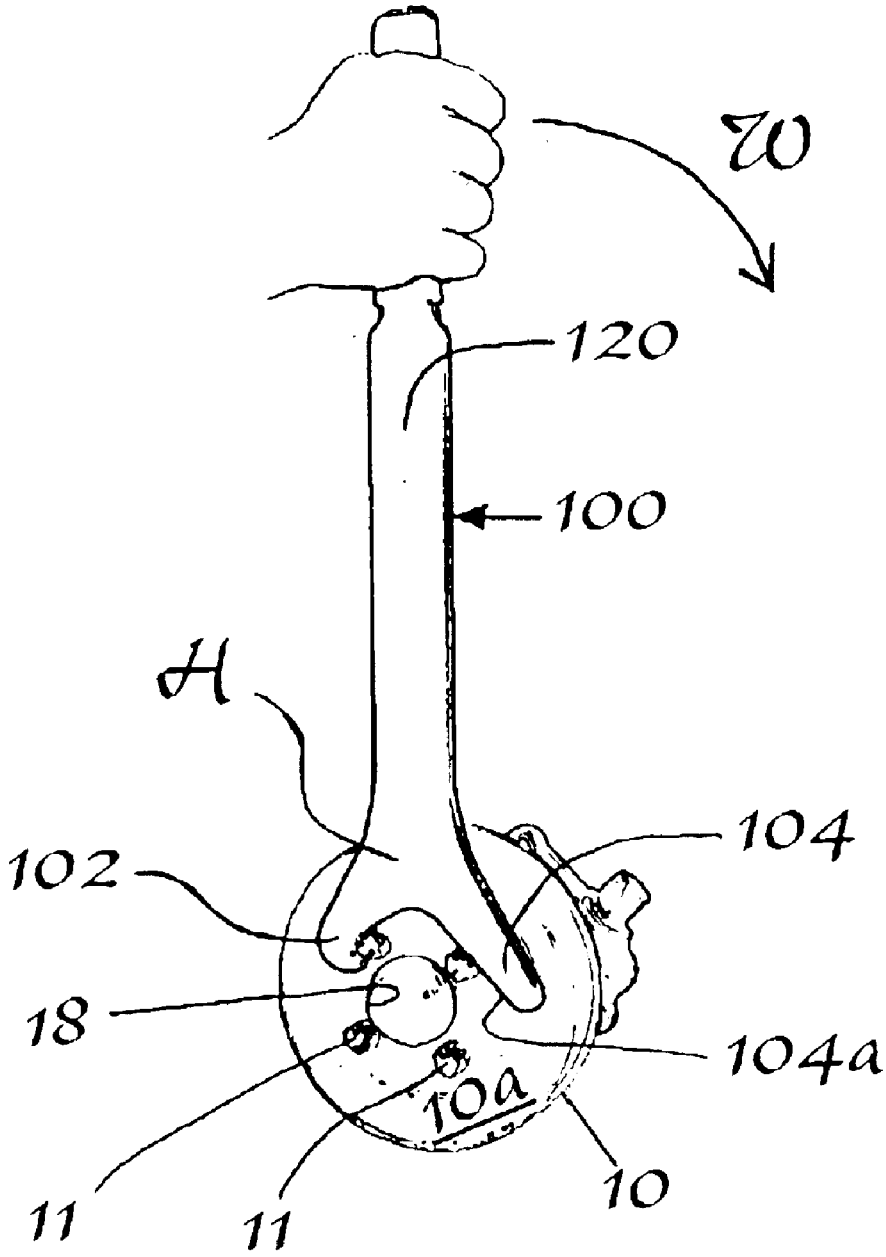
FIG. 3 is a perspective view of the tool shown in FIG. 1 position to engage bolt heads on the water pump pulley when the water pump shaft and viscous fan clutch assembly are being connected.
Figure 4:
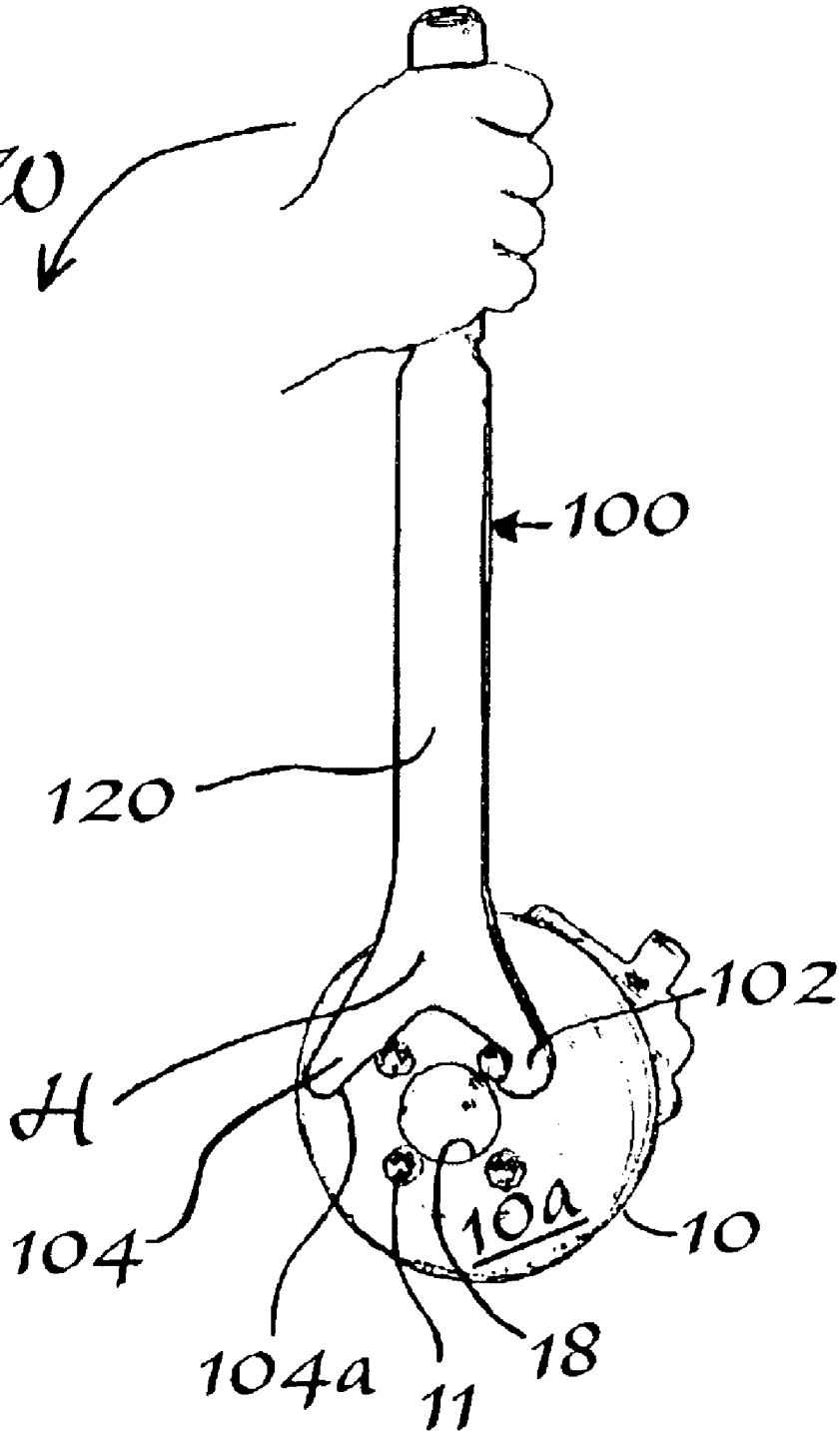
FIG. 4 is a perspective view of the tool shown in FIG. 1 position to engage bolt heads on the water pump pulley when the water pump shaft and viscous fan clutch assembly are being disconnected.

As depicted in FIG. 2, using the holding tool 100, a mechanic holds the fan clutch pulley 10 in position for removal or replacement of the viscous fan clutch assembly 12. Note: use of the wrench W has been eliminated from FIGS. 2, 3 and 4 for clarity. The location of this wrench W is shown in FIG. 5. The mechanic grasps the fastener heads 11 of the fasteners with the hook arm 102 and the lever arm 104 while the tool 100 is oriented so that it is substantially along the same plane as the fastener heads 11. This enables the mechanic to prevent rotation of the pulley 10 while the using a fan clutch specific open-end wrench W to twist and remove the hexagonal nut connector C. In FIG. 3 the arrow W indicates the direction the wrench W is being rotated from an observer's point of view when the viscous fan clutch assembly 12 and the pump 16 are being disconnected. In FIG. 4 the arrow W indicates the direction the wrench W is being rotated from an observer's point of view when the viscous fan clutch assembly 12 and the pump 16 are being connected together.

FIG. 11 illustrates one embodiment of this invention, the tool 600, where a third straight edge segment 104*c* is disposed between the opposed inner ends E1 and E2 of the segments 104*a* and 104*b*, respectively.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

What is claimed is:

1. A method of connecting or disconnecting a water pump pulley attached by a threaded shaft to a connector on a fan clutch, said pulley having at least a pair of fasteners each with a fastener head extending from a surface of the pulley, said heads being adjacent, spaced apart and next to the fan clutch to provide a narrow space between said surface and the fan clutch that is no greater than ¾ inch, said method including the steps of (a) providing a tool comprising a tool head sized to fit into the space between the surface of the pulley and the fan clutch having a thickness from 1/16 to ¾ inch and a width from 2 to 10 inch, said tool head being integral with a handle, the handle defining a tool central longitudinal axis, said tool head including a hook arm and a lever arm joined together to provide a common edge, said common edge having a terminal end including said hook arm, said hook arm and lever arm configured and positioned relative to each other to engage separately the head of each fastener when the tool is positioned in the space between said surface and the fan clutch, said hook arm including an outwardly projecting tip from which an arcuate edge portion curves inward to enable said hook arm to grasp one fastener head of one fastener of said adjacent pair, with the arcuate edge portion bearing against said one fastener head, and said lever arm having a straight edge portion substantially extending to the longitudinal axis, said straight edge portion bears against the adjacent fastener head when said hook arm is grasping said one fastener head of said one fastener, said straight edge portion having an inner end merging with an inner end of the arcuate edge portion, said straight edge portion having a length from 1 to 10 inches, said arcuate edge portion and said straight edge portion forming, at least in part, said common edge and the arcuate edge portion being at a terminal end of the common edge, (b) inserting into the space between said surface and the fan clutch said head of the tool and grasping said one fastener head with the hook element and engaging the other fastener head with the straight edge lever element, and (c) while grasping said one fastener head with the hook element and engaging the other fastener head with the straight edge lever element, inserting into said space a second tool and grasping the connector on the fan clutch, (d) while both tools are engaged, turning one or both said tools to disconnect or connect the threaded shaft of water pump pulley and the connector on the fan clutch.

* * * * *